US011358834B2

(12) United States Patent
Haag et al.

(10) Patent No.: US 11,358,834 B2
(45) Date of Patent: Jun. 14, 2022

(54) ELEVATOR GUIDE RAIL ELEMENT

(71) Applicant: Kone Corporation, Helsinki (FI)

(72) Inventors: Mikael Haag, Helsinki (FI); Harri Makinen, Helsinki (FI)

(73) Assignee: Kone Corporation, Helsinki (FI)

( * ) Notice: Subject to any disclaimer, the term of this patent is extended or adjusted under 35 U.S.C. 154(b) by 27 days.

(21) Appl. No.: 16/902,503

(22) Filed: Jun. 16, 2020

(65) Prior Publication Data

US 2021/0016994 A1 Jan. 21, 2021

(30) Foreign Application Priority Data

Jul. 16, 2019 (EP) ..... 19186420

(51) Int. Cl.
*B66B 7/02* (2006.01)

(52) U.S. Cl.
CPC ..... *B66B 7/026* (2013.01)

(58) Field of Classification Search
CPC ..... B66B 7/026; B66B 7/024; B66B 19/002
See application file for complete search history.

(56) References Cited

U.S. PATENT DOCUMENTS 6,991,070 B1 * 1/2006 Sanz Gamboa ..... B66B 7/02 187/406
9,381,770 B2 * 7/2016 Bjorni ..... B66B 7/026
10,723,591 B2 * 7/2020 Kirsch ..... B66B 7/023
2012/0263554 A1 * 10/2012 Sanz Gamboa ..... B66B 7/026 411/81
2013/0056310 A1 * 3/2013 Bjorni ..... B66B 7/026 187/359
2016/0083222 A1 * 3/2016 Fernandez ..... B66B 5/0087 187/406
2018/0009633 A1 * 1/2018 Fargo ..... B66B 11/0407
2018/0079624 A1 * 3/2018 Kirsch ..... B66B 7/024
2018/0170712 A1 * 6/2018 Fauconnet ..... B66B 7/026
2018/0297815 A1 * 10/2018 Kirsch ..... B66B 7/024
2019/0055108 A1 * 2/2019 Fauconnet ..... B33Y 80/00
2021/0016994 A1 * 1/2021 Haag ..... B66B 19/002
2021/0016996 A1 * 1/2021 Makinen ..... B66B 7/023
2021/0016997 A1 * 1/2021 Haag ..... B66B 19/002
2021/0016998 A1 * 1/2021 Haag ..... B66B 19/002

FOREIGN PATENT DOCUMENTS

JP 08127482 A * 5/1996 ..... B66B 7/026
WO WO-2018/060261 A1 4/2018

OTHER PUBLICATIONS

European Search Report for European Patent Application No. 19186420 dated Mar. 12, 2020.

* cited by examiner

*Primary Examiner* — Michael A Riegelman
(74) *Attorney, Agent, or Firm* — Harness, Dickey & Pierce, P.L.C.

(57) ABSTRACT

The elevator guide rail element comprises a guide rail element having a first jointing clamp attached to a lower end of the guide rail element and a second jointing clamp attached to an upper end of the guide rail element. The first and the second jointing clamp forms a plug-in joint between the first and the second jointing clamp and thereby between two consecutive guide rail elements when the first and the second jointing clamp are connected to each other.

9 Claims, 8 Drawing Sheets

ELEVATOR GUIDE RAIL ELEMENT

RELATED APPLICATIONS

Figure 1:
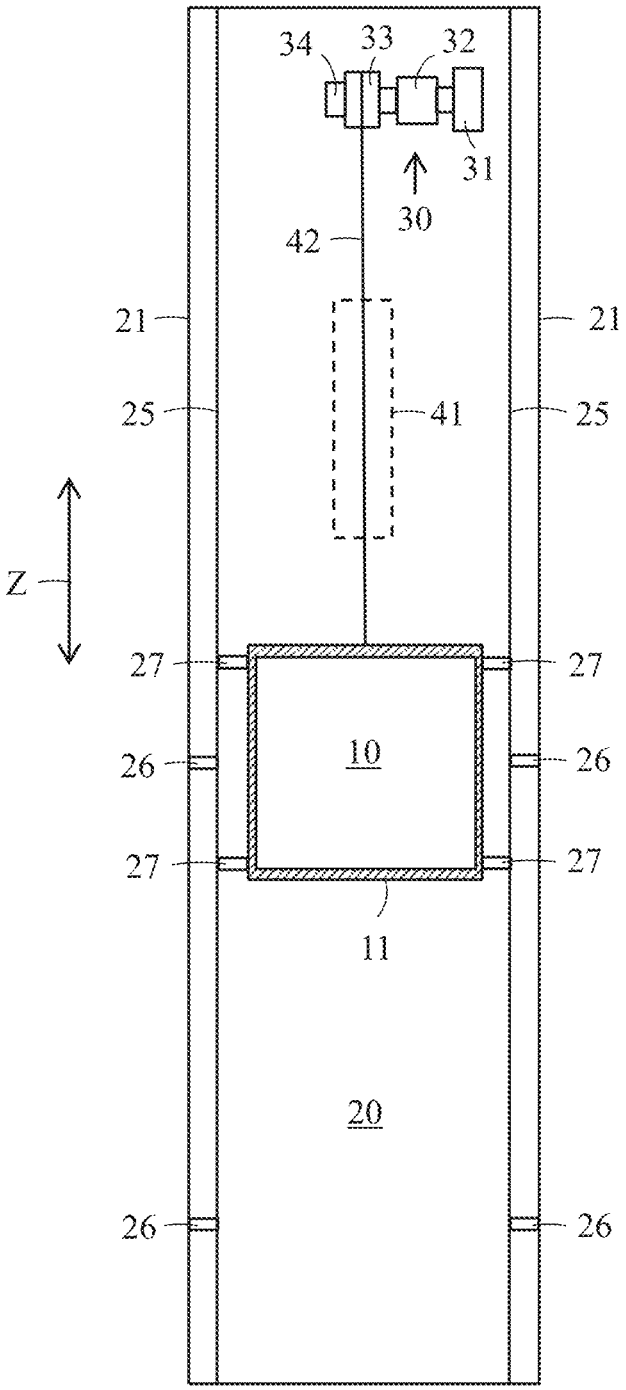

This application claims priority to European Patent Application No. 19186420.6 filed on Jul. 16, 2019, the entire contents of which are incorporated herein by reference.

FIELD

The invention relates to an elevator guide rail element.

BACKGROUND

An elevator may comprise a car, a shaft, hoisting machinery, ropes, and a counterweight. A separate or an integrated car frame may surround the car.

The hoisting machinery may be positioned in the shaft. The hoisting machinery may comprise a drive, an electric motor, a traction sheave, and a machinery brake. The hoisting machinery may move the car upwards and downwards in the shaft. The machinery brake may stop the rotation of the traction sheave and thereby the movement of the elevator car.

The car frame may be connected by the ropes via the traction sheave to the counterweight. The car frame may further be supported with gliding means at guide rails extending in the vertical direction in the shaft. The guide rails may be attached with fastening brackets to the side wall structures in the shaft. The gliding means keep the car in position in the horizontal plane, when the car moves upwards and downwards in the shaft. The counterweight may be supported in a corresponding way on guide rails that are attached to the wall structure of the shaft.

The car may transport people and/or goods between the landings in the building. The wall structure of the shaft may be formed of solid walls or of an open beam structure or of any combination of these.

The guide rails may be formed of guide rail elements of a certain length. The guide rail elements may be connected in the installation phase end-on-end one after the other in the elevator shaft. The guide rail elements may be attached to each other with connection plates extending between the end portions of two consecutive guide rail elements. The connection plates may be attached to the consecutive guide rail elements. The ends of the guide rails may comprise some kind of form locking means in order to position the guide rails correctly in relation to each other. The guide rails may be attached to the walls of the elevator shaft with support means at support points along the height of the guide rails.

Joining the guide rails to each other by using prior art connection plates requires accurate adjustment of the guide rail joints in the elevator shaft during the guide rail installation. This installation work requires normally the use of heavy alignment and measurement tools. There is often also a need to use shimming plates in the adjustment work and multiple bolts must be released and tightened during the adjustment work. Joining the guide rails together in the shaft is thus a time consuming and labour intensive manual task.

The accuracy of the guide rail joint alignment is a critical factor that determines the quality of an elevator installation, especially in case of high-speed elevators.

A fast installation and commissioning of the elevators is an essential step in order to achieve an efficient construction of the whole building.

These problems become even more profound in modern high rise buildings.

SUMMARY

An object of the invention is to provide an improved elevator guide rail element.

The elevator guide rail element according to the invention is defined in claim 1.

The inventive guide rail element provides a fast and accurate joining of guide rail elements in the shaft.

The inventive guide rail element may be used in a manual installation of guide rails as well as in an automatic installation of guide rails. The inventive guide rail element may also be used in any combination of a manual and an automatic installation of guide rails. The inventive guide rail element makes it possible to use a highly automated installation of guide rails.

The invention makes it possible to pre-fabricate the joints between the guide rails outside the shaft before the installation of the guide rails.

The material costs for the jointing clamps are modest. The savings in the installation time of the guide rails will compensate for these extra material costs.

DRAWINGS

Figure 2:
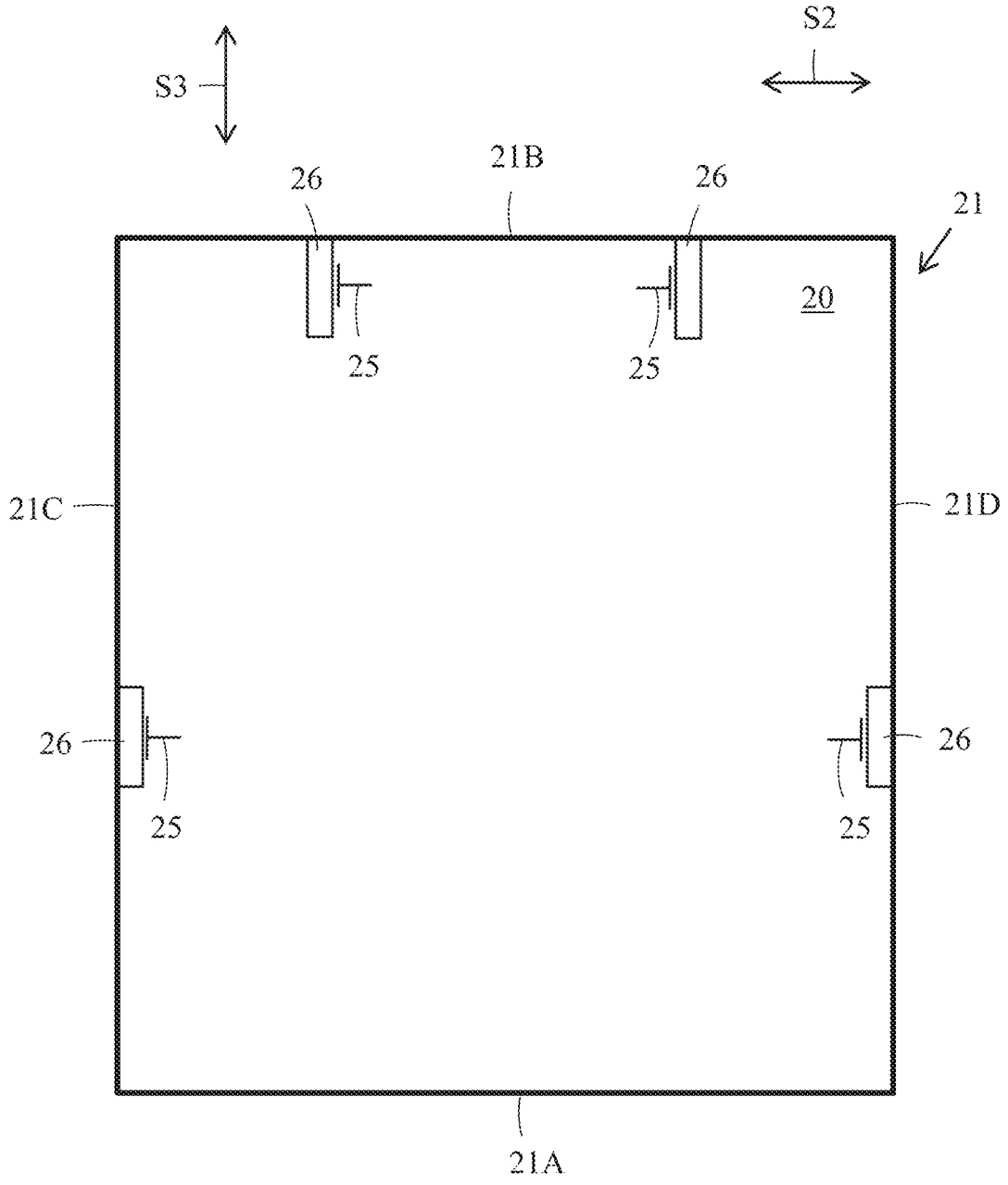
Figure 3:
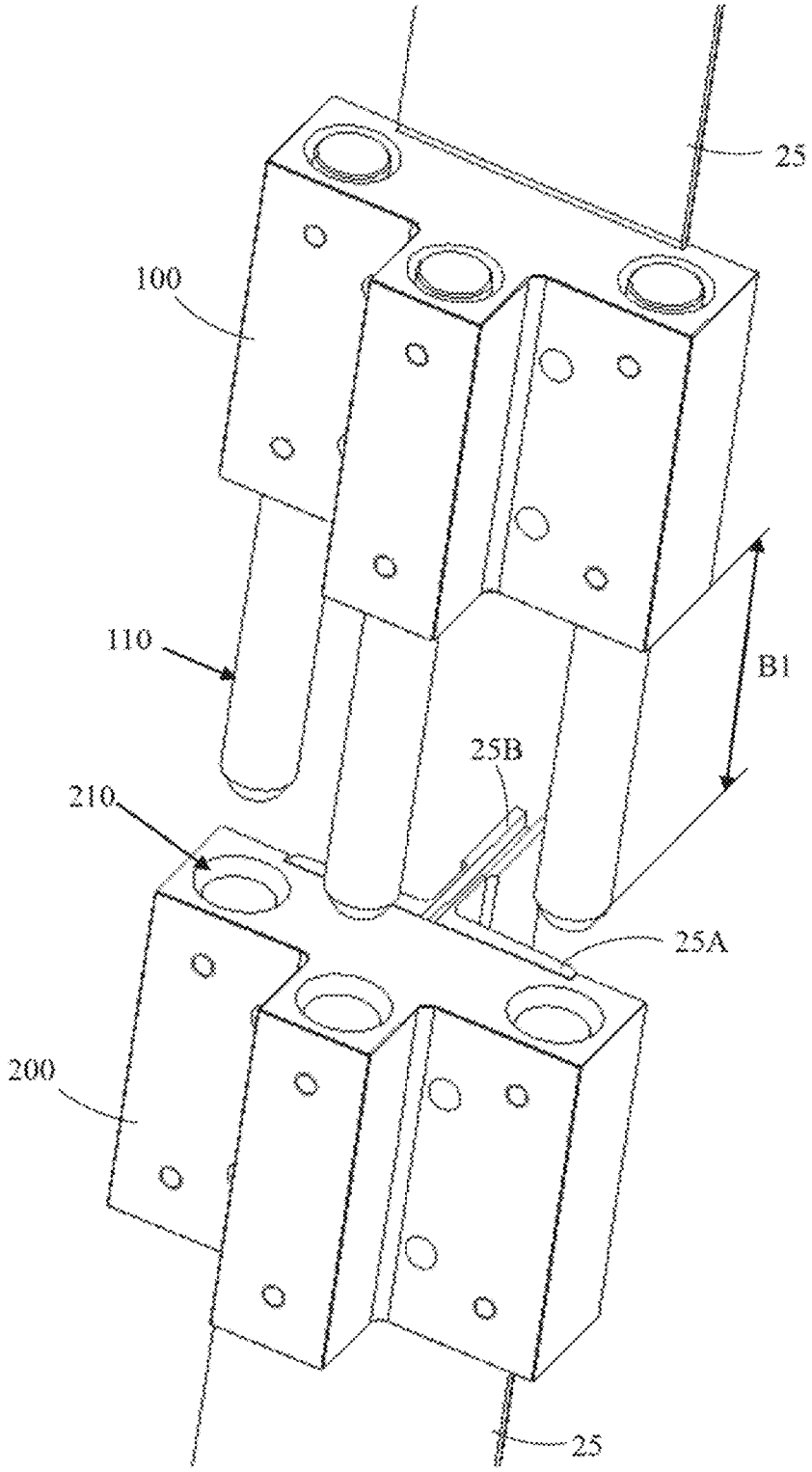
Figure 4:
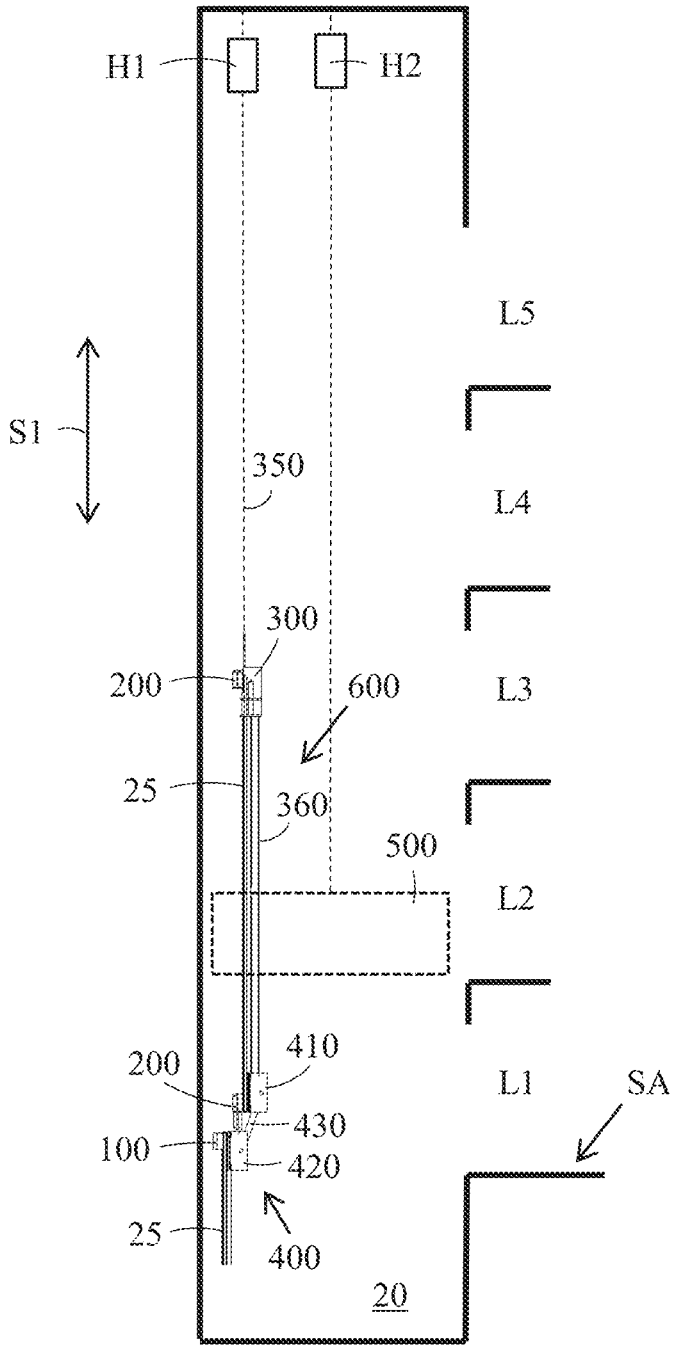
Figure 5:
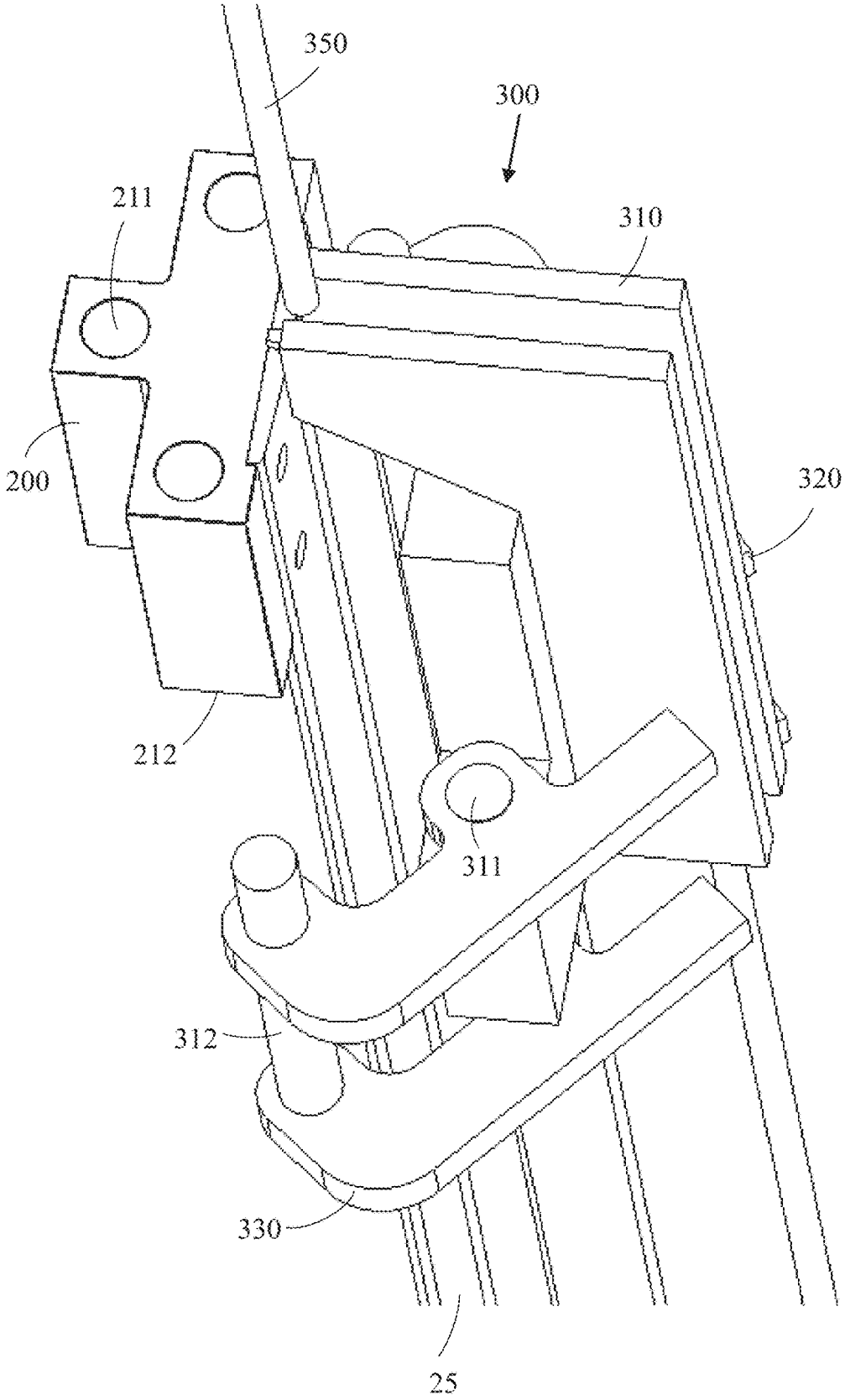
Figure 6:
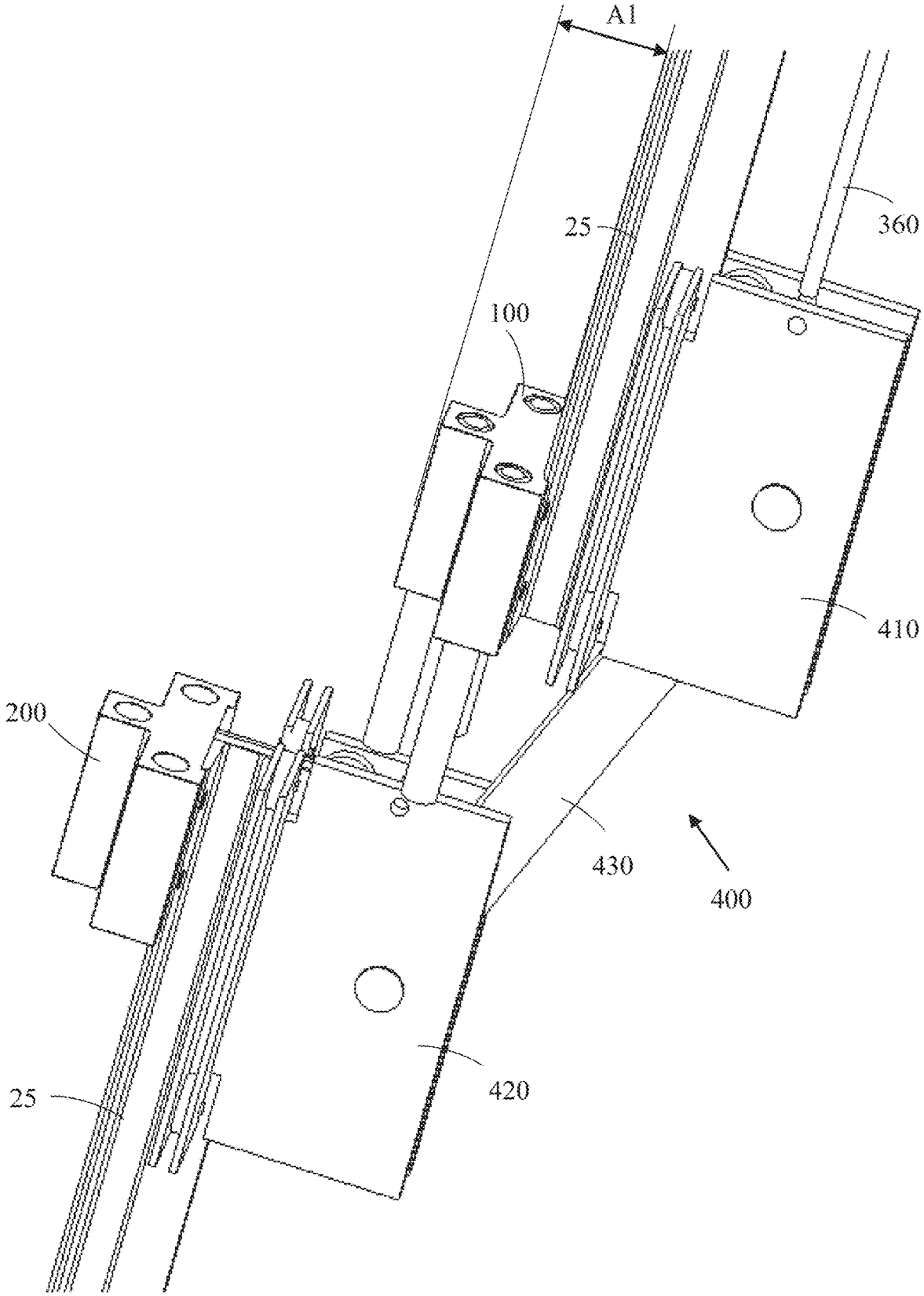
Figure 7:
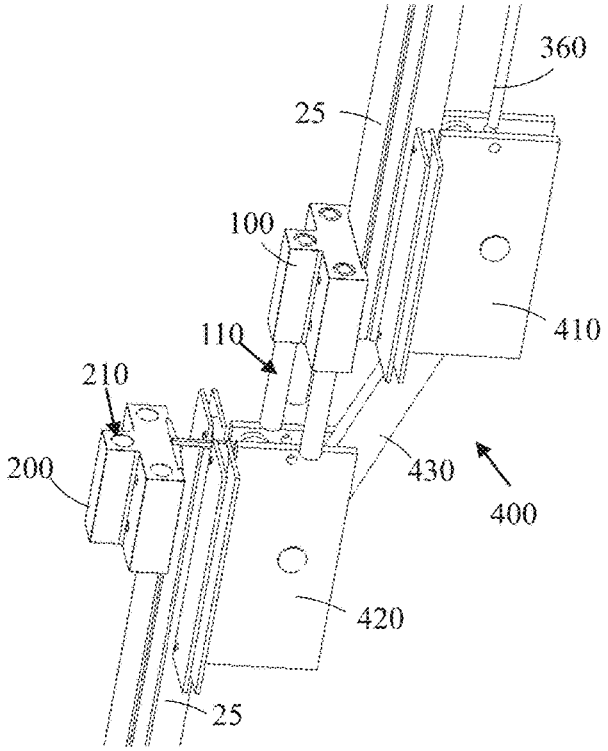
Figure 8:
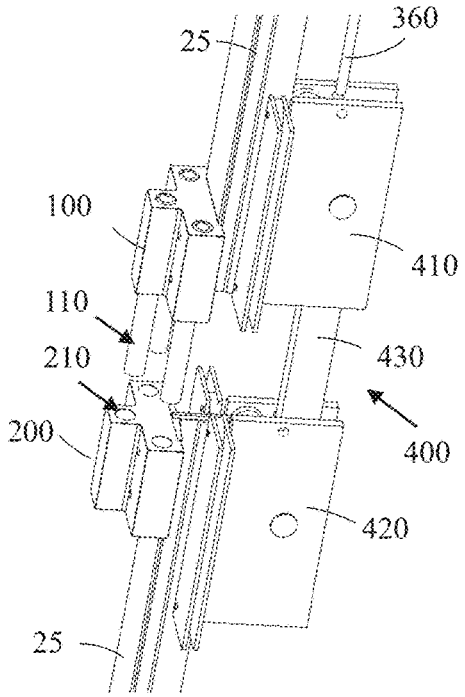
Figure 9:
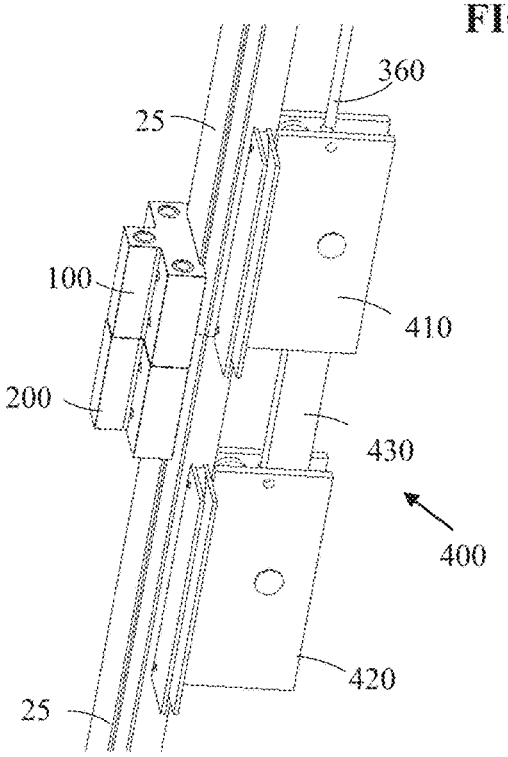
Figure 10:
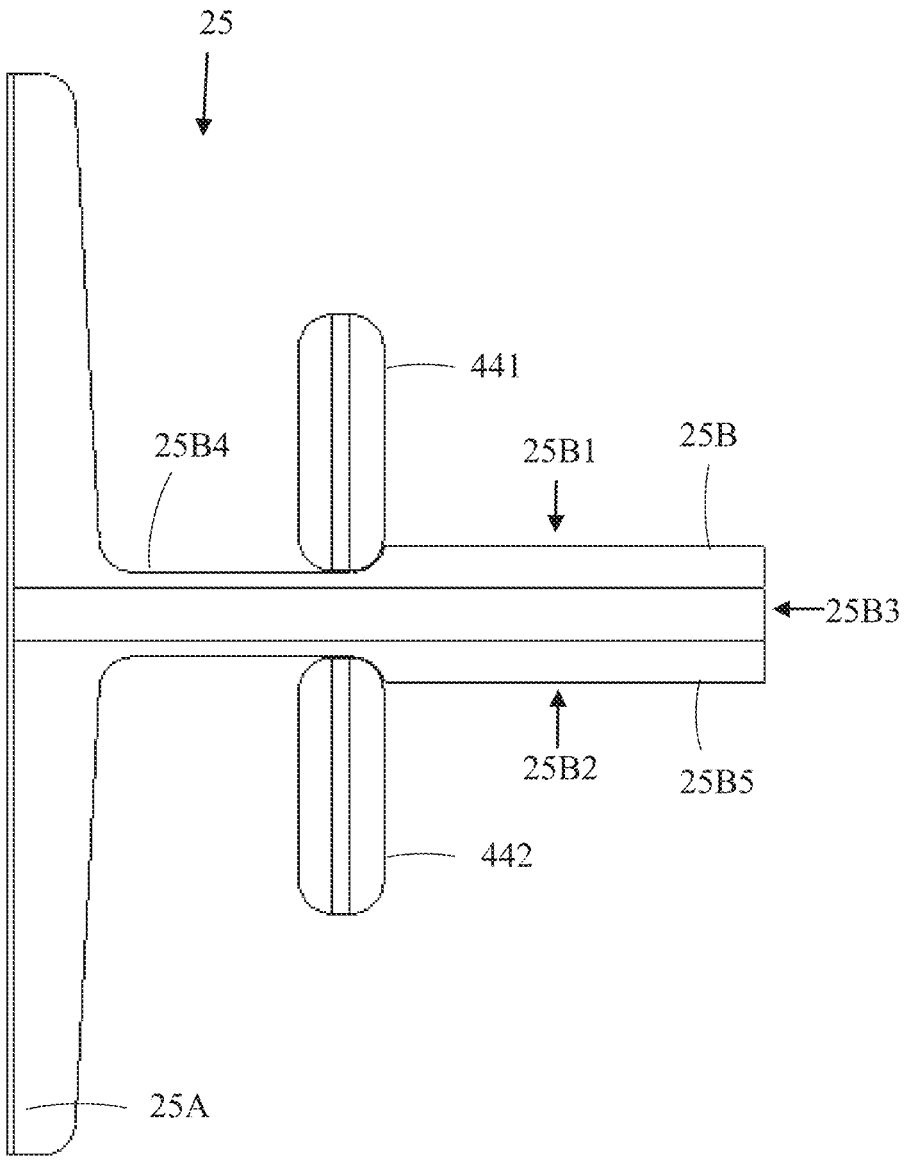

The invention will in the following be described in greater detail by means of preferred embodiments with reference to the attached drawings, in which FIG. 1 shows a side view of an elevator, FIG. 2 shows a horizontal cross section of the elevator, FIG. 3 shows guide rail elements according to the invention, FIG. 4 shows an arrangement for installing guide rails, FIG. 5 shows a hook device of a transport apparatus, FIG. 6 shows a lever device of a transport apparatus, FIGS. 7-9 show the lever device of the transport apparatus in different positions, FIG. 10 shows a cross-section of a guide rail.

DETAILED DESCRIPTION

FIG. 1 shows a side view and FIG. 2 shows a horizontal cross section of the elevator.

The elevator may comprise a car 10, an elevator shaft 20, hoisting machinery 30, ropes 42, and a counterweight 41. A separate or an integrated car frame 11 may surround the car 10.

The hoisting machinery 30 may be positioned in the shaft 20. The hoisting machinery may comprise a drive 31, an electric motor 32, a traction sheave 33, and a machinery brake 34. The hoisting machinery 30 may move the car 10 in a vertical direction Z upwards and downwards in the vertically extending elevator shaft 20. The machinery brake 34 may stop the rotation of the traction sheave 33 and thereby the movement of the elevator car 10.

The car frame 11 may be connected by the ropes 42 via the traction sheave 33 to the counterweight 41. The car frame 11 may further be supported with gliding means 27 at guide rails 25 extending in the vertical direction in the shaft 20. The gliding means 27 may comprise rolls rolling on the guide rails 25 or gliding shoes gliding on the guide rails 25 when the car 10 is moving upwards and downwards in the elevator shaft 20. The guide rails 25 may be attached with fastening brackets 26 to the side wall structures 21 in the elevator shaft 20. The gliding means 27 keep the car 10 in position in the horizontal plane when the car 10 moves upwards and downwards in the elevator shaft 20. The counterweight 41 may be supported in a corresponding way on guide rails that are attached to the wall structure 21 of the shaft 20.

The wall structure 21 of the shaft 20 may be formed of solid walls 21 or of open beam structure or of any combination of these. One or more of the walls may thus be solid and one or more of the walls may be formed of an open beam structure. The shaft 20 may be comprise a front wall 21A, a back wall 21B and two opposite side walls 21C, 21D. There may be two guide rails 25 for the car 10. The two car guide rails 25 may be positioned on opposite side walls 21C, 21D. There may further be two guide rails 25 for the counterweight 41. The two counterweight guide rails 25 may be positioned on the back wall 21B.

The guide rails 25 may extend vertically along the height of the elevator shaft 20. The guide rails 25 may thus be formed of guide rail elements of a certain length e.g. 5 m. The guide rail elements 25 may be installed end-on-end one after the other. The guide rail elements 25 may in prior art solutions be attached to each other with connection plates extending between the end portions of two consecutive guide rail elements 25. The connection plates may be attached to the consecutive guide rail elements 25. The ends of the guide rails 25 may comprise some kind of form locking means in order to position the guide rails 25 correctly in relation to each other. The guide rails 25 may be attached to the walls 21 of the elevator shaft 20 with support means at support points along the height of the guide rails 25.

The car 10 may transport people and/or goods between the landings in the building.

FIG. 1 shows a first direction S1, which is a vertical direction in the elevator shaft 20. FIG. 2 shows a second direction S2, which is the direction between the guide rails (DBG) and a third direction S3, which is the direction from the back wall to the front wall (BTF) in the shaft 20. The second direction S2 is perpendicular to the third direction S3. The second direction S2 and the third direction S3 are perpendicular to the first direction S1.

FIG. 3 shows guide rail elements according to the invention.

The figure shows a lower end portion of an upper guide rail element 25 and an upper end portion of a lower guide rail element 25. The two guide rail elements 25 are to be joined together.

A cross-section of the guide rail element 25 may have the form of an inverted letter T having a flat bottom portion 25A and a flat support portion 25B protruding outwardly from the middle of the bottom portion 25A. The guide rail element 25 may be attached with brackets to a wall 21 in the shaft 20 from the bottom portion 25A of the guide rail element 25. The support portion 25B of the guide rail element 25 may form two opposite side support surfaces and one end support surface for the support shoes of the car 10 or the counterweight 41. The support shoes may be provided with gliding surfaces or rollers acting on the support surfaces of the support portion 25B of the guide rail element 25.

Each guide rail element 25 may be provided with a first jointing clamp 100 attached to a first end of the guide rail element 25 and a second jointing clamp 200 attached to a second opposite end of the guide rail element 25. The first end of the guide rail element 25 may be the lower end of the guide rail element 25 and the second end of the guide rail element 25 may be the upper end of the guide rail element 25. The figure shows the first jointing clamp 100 on the lower end of the upper guide rail element 25 and the second jointing clamp 200 on the upper end of the lower guide rail element 25.

Each guide rail element 25 may be provided with transverse through holes in the bottom portion of the guide rail element 25 at each end of the guide rail element 25. The first jointing clamp 100 and the second jointing clamp 200 may on the other hand be provided with corresponding threaded holes. Bolts may pass through the holes in the bottom portion in the guide rail element 25 into the threaded holes in the first and the second jointing clamp 100, 200 in order to attach the first and the second jointing clamp 100, 200 to the respective end of the guide rail element 25. The jointing clamps 100, 200 are thus positioned on an opposite surface of the bottom portion of the guide rail 25 in relation to the support portion of the guide rail 25.

A first outer end of the first jointing clamp 100 may be substantially flush with the lower end of the guide rail element 25. The first jointing clamp 100 may comprise male joint elements 110 extending in a longitudinal direction outwards from the first end of the first jointing clamp 100. The longitudinal direction may coincide with the longitudinal direction of the guide rail element 25. The male joint elements 110 may be adapted to pass into corresponding female joint elements 210 in the second jointing clamp 200. The male joint elements 110 may have an equal axial length B1. The axial length B1 of the male joint elements 110 could on the other hand be staggered. The benefit of using male joint elements 110 with a staggered axial length B1 would be to be able to guide the first jointing clamp 100 and the second jointing clamp 200 into a correct position in relation to each other in one direction at a time. The first jointing clamp 100 and the second jointing clamp 200 may be pre-set into correct positions on the guide rail elements 25. The pre-setting is beneficial when using male joint elements 110 with an equal axial length B1.

The male joint elements 110 may be formed of pins. A transverse cross-section of the pins may be circular. The female joint elements 210 may be formed of holes. A transverse cross-section of holes corresponds to the transverse cross-section of the pins.

The number of male joint elements 110 as well as the number of female joint elements 210 is three in this embodiment, but there could be any number of male joint elements 110 in the first jointing clamp 100 and a corresponding number of female joint elements 210 in the second jointing clamp 200. There may thus be at least one male joint element 110 in the first jointing clamp 100 and at least one female joint element 210 in the second jointing clamp 200. The three male joint elements 110 and the three female joint elements 210 may be positioned in the corners of a triangle.

The number of male joint elements 110 in the first jointing clamp 100 and the number of female joint elements 220 in the second jointing clamp 200 may be equal.

The first jointing clamp 100 and the second jointing clamp 200 may form a plug-in joint between two consecutive guide rail elements 25.

The first jointing clamp 100 may be produced so that through holes are bored in the longitudinal direction of the first jointing clamp 100. The male joint elements 110 are then inserted into the holes and attached in the holes with a pressure joint. There will thus remain blind bored holes extending into the first jointing clamp 100 from the second inner end of the first jointing clamp 100.

A first outer end of the second jointing clamp 200 may be substantially flush with the upper end of the guide rail element 25. The second jointing clamp 200 may comprise holes 210 passing in a longitudinal direction into the second jointing clamp 200 from the first end of the second jointing clamp 200. The longitudinal direction may coincide with the longitudinal direction of the guide rail element 25. The holes 210 may be through holes passing through the second jointing clamp 200.

The two consecutive guide rail elements 25 will be in a correct position in relation to each other when the pins 110 of the first jointing clamp 100 have been pushed fully into the holes 210 of the second jointing clamp 200. The first end surface of the first jointing clamp 100 and the first end surface of the second jointing clamp 200 are then positioned against each other. The opposite surfaces of the two consecutive guide rail elements 25 are also positioned against each other in this position.

The weight of the one or more upper guide rail element 25 will keep the first jointing clamp 100 and the second jointing clamp 200 together. The guide rail elements 25 will naturally also be attached to the wall 21 of the shaft 20 with brackets, whereby movement of the guide rail elements 25 in any direction is eliminated. There is thus probably no need for a separate locking between the first jointing clamp 100 and the second jointing clamp 200. It is naturally possible to provide a separate locking between the first jointing clamp 100 and the second jointing clamp 200 if needed. The locking could be realized as a snap locking between the first jointing clamp 100 and the second jointing clamp 200.

Another possibility would be to provide e.g. the outer end of the middlemost pin 110 with a threading. The middlemost pin 110 could be made long enough so that the outer end of the pin would protrude out from the opposite end of the second jointing clamp 200, when the first jointing clamp 100 and the second jointing clamp 200 are joined together. A nut could then be screwed on the threading in the middlemost pin 110 in order to lock the two jointing clamps 100, 200 together.

The opposite end surfaces of two consecutive guide rail elements 25 may further be provided with a form locking. One end surface could be provided with a groove and the opposite end surface could be provided with a protrusion seating into the groove.

The first jointing clamp 100 and the second jointing clamp 200 may be made of cast iron or of aluminium.

The pins 110 in the first jointing clamp 100 may be made of cold drawn steel bars. The pins 110 could on the other hand also be made of plastic.

The outer ends of the pins 110 in the first jointing clamp 100 may be chamfered in order to facilitate the alignment of the pins 110 into the holes 210 in the second jointing clamp 200.

FIG. 4 shows an arrangement for installing guide rails.

The figure shows five landings L1-L5 in the shaft 20, but there could naturally be any number of landings in the shaft 20.

A first hoist H1 may be arranged in the shaft 20 in order to move a transport apparatus 600 upwards and downwards in the shaft 20. The first hoist H1 may be suspended from a ceiling of the shaft 20.

A second hoist H2 may be arranged in the shaft 20 in order to move a transport platform 500 upwards and downwards in the shaft 20. The second hoist H2 may be suspended from the ceiling of the shaft 20.

The transport platform 500 may be supported with rolls on opposite solid walls 21 in the shaft 20. There is no need to connect the transport platform 500 to the guide rails 25 in any way. The transport platform 500 may be used to transport one or more technicians and/or one or more robots and/or tools in the shaft 20. A horizontal cross-section of the transport platform 500 may be provided with passages for the guide rails 25. The transport platform 500 may be used for scanning the shaft before the elevator installation and/or for installing the guide rails to the wall 21 of the shaft 20 and/or for aligning the guide rails 25 after the elevator installation.

A storage area SA may be arranged on the first landing L1. The storage area SA could naturally be arranged at any position below the working level of the guide rail installation. The storage area SA could first be positioned on the first landing L1 and then later relocated to a higher landing as the installation advances. The guide rail elements 25 may be stored on the storage area SA and lifted with the transport apparatus 600. The guide rail elements 25 may be loaded manually on the transport apparatus 600.

A first lowermost section of guide rails 25 may first be installed into the shaft 20 manually. The transport platform 500 may be used in the manual installation of the first section of guide rails 25 to the shaft 20.

The figure shows a situation in which a first guide rail 25 in a second section of guide rails 25 is lifted upwards in the shaft 20 with the transport apparatus 600 connected to the first hoist H1. The transport apparatus 600 may comprise a hook device 300 connected to the first hoist H1 and a lever device 400 connected to the hook device 300. The hook device 300 may be connected with a first wire 350 to the first hoist H1. The lever device 400 may be connected with a second wire 360 to the hook device 300. The lever device 400 may comprise an upper lever part 410 and a lower lever part 420 connected with a lever arm 430.

An upper end of the guide rail element 25 to be lifted may be attached to the hook device 300 and thereby to the first hoist H1.

A lower end of the guide rail element 25 to be lifted may be attached to the upper lever part 410. The lower lever part 420 may be glidingly supported on the row of already installed guide rail elements 25.

The new guide rail element 25 may thus be lifted with the first hoist H1 and the transport apparatus 600 along the row of already installed guide rail elements 25. The upper end of the new guide rail element 25 may be firmly attached to the hook device 300. The lifting force is thus transferred from the first hoist H1 to the hook device 300 and further to the new guide rail element 25. The lower end of the new guide rail element 25 may be attached to the upper lever part 410. The lower lever part 420 may glide on the already installed row of guide rails 25. The lower lever part 420 may be glidingly connected to the row of already installed guide rail elements 25 during the upward movement.

The new guide rail element 25 may be lifted along the row of already installed guide rail elements 25 to a height in which the lower lever part 420 reaches the upper end of the row of already installed guide rail elements 25.

The lower end of the new guide rail element 25 may now be disconnected from the lever device 400. The new guide rail element 25 may thereafter be connected to the uppermost guide rail element 25 in the row of already installed guide rail elements 25. The new guide rail element 25 may further be attached to the wall 21 of the shaft 20. This may be done from the transport platform 500 movable with the second hoist H2.

The transport device 600 may thereafter be moved downwards along the row of already installed guide rail elements 25 with the first hoist H1. The hook device 300 and the lever device 400 may glide on the row of already installed guide rail elements 25 when moving downwards. The hook device 300 and the lever device 400 may be glidingly supported of the row of already installed guide rail elements 25.

The installation work from the transport platform 500 may be done manually by one or more technicians and hand tools and/or automatically with one or more robots.

FIG. 5 shows a hook device of a transport apparatus.

The hook device 300 may comprise a body portion 310 and two locking members 320, 330 pivotably attached to the body portion 310. Each locking member 320, 330 may comprise two parallel rocker arms at a distance from each other. The rocker arms may be pivotably supported via a first shaft 311 on the body portion 310. A second shaft 312 may pass between the outer ends of the rocker arms. The second shaft 312 may protrude upwards from the upper rocker arm. The rocker arms may be spring loaded. The locking members 320, 330 are shown in an open position in the figure. The locking members 320, 330 turn into the locking position when there is tension in the first support wire 350 passing to the first hoist H1. The outer ends of the locking members 320, 330 provided with the second shaft 312 will thus turn towards each other so that the outer ends of the second shaft 312 protrude into a respective hole 211, 212 in the second jointing clamp 200 attached to the end of the guide rail element 25.

The locking members 320, 330 will turn into the open position shown in the figure when the tension in the first wire 350 passing to the first hoist H1 is released. The hook 300 will fall downwards so that the outer ends of the second shaft 312 of the locking members 320, 330 falls out from the respective holes 211, 212 in the second jointing clamp 200. The spring means will then push the locking members 320, 330 into the open position shown in the figure.

The hook device 300 may, when the locking members 320, 330 are in the open position, glide along the row of already installed guide rail elements 25 downwards when the first hoist H1 unwinds the first support wire 350 passing from the first hoist H1 to the hook 300. The weight of the hook device 300 will ensure that the hook device 300 glides downwards along the row of already installed guide rail elements 25 when the first support wire 350 is unwounded from the first hoist H1.

FIG. 6 shows a lever device of a transport apparatus.

The lever device 400 may comprise an upper lever part 410 and a lower lever part 420. The lower lever part 420 may glide on the already installed guide rail 25. A lower end of the guide rail element 25 to be lifted may be connected to the upper lever part 410. The upper lever part 410 may be connected to the lower lever part 420 via a lever arm 430. Both ends of the lever arm 430 may be attached to the respective lever part 410, 420 with a pivot attachment.

The lower lever part 420 may glide on the row of already installed guide rail elements 25 in the shaft 20. The lower end of the guide rail element 25 to be lifted may be supported on the upper lever part 410. The lever arm 430 may be inclined so that the guide rail element 25 to be lifted may be kept at a distance from the row of already installed guide rail elements 25. The upper lever part 410 may be kept at a distance A1 from the already installed row of guide rail elements 25. This distance A1 leaves room for the new guide rail element 25 to pass on the outer side of the already installed row of guide rail elements 25 when the new guide rail element 25 is lifted upwards along the row of already installed guide rail elements 25.

FIGS. 7-9 show the lever device of the transport apparatus in different positions.

The first hoist H1 is connected with a first wire 350 to the transport apparatus 600 i.e. to the hook device 300 of the transport apparatus 600 positioned at the upper end of the transport apparatus 600. The lever device 400 of the transport apparatus 600 is connected with a second wire 360 to the hook device 300. (see FIG. 4).

FIG. 7 shows the lever device 400 in a position in which the lever device 400 has just reached the upper end of the row of already installed guide rail elements 25.

FIG. 8 shows the lever device 400 in a position in which the lower part 420 of the lever device has stopped at the upper end of the row of already installed guide rail elements 25. The locking of the lever arm 430 has been released and the lever arm 430 has been stretched out into a straight position in relation to the longitudinal direction of the row of already installed guide rail elements 25.

FIG. 9 shows the lever device 400 in a position in which the lever device 400 has moved downwards so that the pins 110 in the first jointing clamp 100 have been pushed into the respective holes 210 in the second jointing clamp 200.

FIG. 10 shows a cross-section of a guide rail.

A cross-section of the guide rail element 25 may have the form of a letter T having a flat bottom portion 25A and a flat support portion 25B protruding outwardly from the middle of the bottom portion 25A. The guide rail element 25 may be attached with brackets to a wall 21 in the shaft 20 from the bottom portion 25A of the guide rail element 25. The support portion 25B of the guide rail element 25 may form two opposite side support surfaces 2561, 25B2 and one end support surface 25B3 for the support shoes of the car 10 or the counterweight 41. The support shoes may be provided with gliding surfaces or rollers acting on the support surfaces 2561, 25B2, 25B3 of the support portion 25B of the guide rail element 25.

The hook device 300 and the lever device 400 i.e. the upper lever part 410 and the lower lever part 420 may be provided with rollers 441, 442 or gliding shoes rolling or gliding on the inner thinner portion 25B4 of the support portion 25B of the guide rail 25. The rollers 441, 442 or gliding shoes may be positioned in the transition between the lower thinner portion 25B4 and the outer thicker portion 25B5 of the support portion 25B of the guide rail 25. The rollers 441, 442 in the hook device 300 will keep the hook device 300 secured to the guide rail 25 during the downwards movement of the hook device 300 on the guide rail 25. The rollers 441, 442 in the lower lever part 420 will keep the lever device 400 secured to the guide rail 25 during the upwards and downwards movement of the lever device 400 on the guide rail 25. The rollers 441, 442 in the upper lever part 410 will keep the lower end of the new guide rail element 25 secured to the upper lever part 410 during the upwards movement of the transport device 600 on the guide rail 25.

The rollers 441, 442 may be movably supported in the hook device 300 and in the lever device 400. The rollers 441, 442 may be moved between a first position in which the rollers 441, 442 are in contact with the guide rail 25 as seen in the figure and a second position in which the rollers 441, 442 are out of contact from the guide rail 25. The hook device 300 and the lever device 400 may be disconnected from the guide rail 25 when the rollers 441, 442 are in the second position.

The installation of guide rail elements 25 may be done automatically with the first hoist H1, the transport apparatus 600 and the transport platform 500. Manual work may be needed when loading guide rail elements 25 on the transport apparatus 600.

The jointing clamps 100, 200 may be adjusted e.g. by shimming and/or grinding into exactly correct positions when they are attached to the ends of the guide rail element 25. The jointing clamps 100, 200 will thus be in a correct position on the guide rail elements 25 when the guide rail elements 25 are installed to the shaft 20.

The guide rails 25 may be aligned after they have been installed to the respective walls 21 in the shaft 20. The alignment of the guide rails 25 may be done in any known manner.

FIG. 4 shows an embodiment in which only one first hoist H1 with a transport device 600 is used. The suspension point for the first hoist H1 would thus have to be changed during the installation. Each row of guide rails 25 to be installed would need a suspension point of their own for the first hoist H1. Several first hoists H1 could naturally be suspended from the ceiling of the shaft 20. Each first hoist H1 would thus be provided with a transport device 600 of its own. This would mean that several rows of guide rails 25 could be installed simultaneously into the shaft 20.

FIG. 4 shows only one example of an installation arrangement for installing guide rails that could be used in connection with elevator guide rail elements according to the invention. The elevator guide rail elements according to the invention are, however, not in any way restricted to this installation arrangement. The elevator guide rail elements according to the invention can be used in connection with any kind of installation arrangement for installing elevator guide rails. The guide rail elements according to the invention may be used in connection with manual and automatic guide rail installation methods and in any combination of manual and automatic installation methods.

The shaft 20 in the figures is intended for only one car 10, but the invention could naturally be used in shafts intended for several cars 10. Such elevator shafts 10 could be divided into sub-shafts for each car 10 with steel bars. Horizontal steel bars could be provided at predetermined intervals along the height of the shaft 20. A part of the guide rails 25 would then be attached to the steel bars in the shaft 20. Another part of the guide rails 25 would be attached to solid walls 21 in the shaft 20.

The invention may be used in low rise or in high rise buildings. The benefits of the invention are naturally greater in high rise buildings. High rise buildings may have a hoisting height over 75 meters, preferably over 100 meters, more preferably over 150 meters, most preferably over 250 meters.

The use of the invention is not limited to the elevator disclosed in the figures. The invention can be used in any type of elevator e.g. an elevator comprising a machine room or lacking a machine room, an elevator comprising a counterweight or lacking a counterweight. The counterweight could be positioned on either side wall or on both side walls or on the back wall of the elevator shaft. The drive, the motor, the traction sheave, and the machine brake could be positioned in a machine room or somewhere in the elevator shaft. The car guide rails could be positioned on opposite side walls of the shaft or on a back wall of the shaft in a so called ruck-sack elevator.

It will be obvious to a person skilled in the art that, as the technology advances, the inventive concept can be implemented in various ways. The invention and its embodiments are not limited to the examples described above but may vary within the scope of the claims.

The invention claimed is:

1. An elevator guide rail element, comprising:

a guide rail element having a first jointing clamp attached to a lower end of the guide rail element and a second jointing clamp attached to an upper end of the guide rail element, the first jointing clamp and the second jointing clamp forming a plug-in joint between the first jointing clamp and the second jointing clamp and thereby between two consecutive guide rail elements when the first jointing clamp and the second jointing clamp are connected to each other, wherein a cross-section of the guide rail element has a form of an inverted letter T having a flat bottom portion and a flat support portion protruding outwardly from a middle of the flat bottom portion, wherein the first and second jointing clamps are attached to an opposite side of the flat bottom portion of the guide rail element in relation to the flat support portion of the guide rail element, such that the flat bottom portion of the guide rail element is between the flat support portion of the guide rail element and the first and second jointing clamps.

2. The elevator guide rail element according to claim 1, wherein the first jointing clamp comprises one of a male joint element or a female joint element, and the second jointing clamp comprises a different one of the male joint element or the female joint element, and the male joint element and the female joint element form the plug-in joint between the first jointing clamp and the second jointing clamp and thereby between two consecutive guide rail elements when the first jointing clamp and the second jointing clamp are connected to each other.

3. The elevator guide rail element according to claim 2, wherein the male joint element is formed of a pin and the female joint element is formed of a hole configured to receive the pin.

4. The elevator guide rail element according to claim 3, wherein a transverse cross-section of the pin is circular.

5. The elevator guide rail element according to claim 3, wherein an outer end of the pin is chamfered.

6. The elevator guide rail element according to claim 2, wherein the first jointing clamp comprises a plurality of male joint elements, the plurality of male joint elements including the male joint element, and an axial length of the plurality of male joint elements is equal.

7. The elevator guide rail element according to claim 2, wherein the first jointing clamp comprises a plurality of male joint elements, and the plurality of male joint elements have different axial lengths in relation to each other.

8. The elevator guide rail element according to claim 2, wherein the first jointing clamp comprises three male joint elements, the three male joint elements including the male joint element, and the second jointing clamp comprises three female joint elements, the three female joint elements including the female joint element.

9. The elevator guide rail element according to claim 8, wherein the three male joint elements and the three female joint elements are positioned in separate corners of a triangle.

* * * * *